United States Patent [19]

Lester et al.

[11] 4,171,597

[45] Oct. 23, 1979

[54] CRANE BOOM AND TELESCOPIC SECTION FOR IT

[75] Inventors: Robert J. Lester, Cleadon, near Sunderland; William Jack, Gerrards Cross, both of England

[73] Assignee: Coles Cranes Limited, Crown Works, England

[21] Appl. No.: 913,270

[22] Filed: Jun. 7, 1978

Related U.S. Application Data

[63] Continuation-in-part of Ser. No. 761,036, Jan. 21, 1977, abandoned.

[30] Foreign Application Priority Data

Jan. 29, 1976 [GB] United Kingdom ..... 3444/76

[51] Int. Cl.[2] ..... E04H 12/34

[52] U.S. Cl. ..... 52/118; 52/632; 52/731; 212/144

[58] Field of Search ..... 52/118, 115, 731, 632; D12/57, 60; 212/144; 182/2; 173/43

[56] References Cited

U.S. PATENT DOCUMENTS

| | | | |
|---|---|---|---|
| 2,031,549 | 2/1936 | Ruff | 212/144 X |
| 2,763,342 | 9/1956 | French | 52/632 X |
| 2,920,725 | 1/1960 | Emmons | 52/118 |
| 3,196,990 | 7/1965 | Handley | 52/731 |
| 3,571,991 | 3/1971 | Dooey et al. | 52/731 X |
| 3,610,433 | 10/1971 | Milner | 212/144 |
| 3,690,408 | 9/1972 | Reske et al. | 182/2 |
| 3,708,937 | 1/1973 | Sterner | 52/118 |
| 3,802,136 | 4/1974 | Eiler et al. | 52/118 X |
| 3,952,466 | 4/1976 | Spain | 52/118 |
| 3,985,234 | 10/1976 | Jouffray | 52/118 |
| 4,003,168 | 1/1977 | Brady | 52/118 |
| 4,038,794 | 8/1977 | Young | 212/144 |

FOREIGN PATENT DOCUMENTS

| | | | |
|---|---|---|---|
| 124239 | 5/1947 | Australia | 52/731 |
| 272618 | 7/1969 | Austria | 52/731 |
| 379522 | 4/1973 | U.S.S.R. | 212/144 |

*Primary Examiner*—Leslie Braun

*Attorney, Agent, or Firm*—Sughrue, Rothwell, Mion, Zinn and Macpeak

[57] ABSTRACT

A section for a telescopically extensible crane is octagonal in cross-section. The section has relatively thick upper and lower parallel plates, and side members each having a part inclined outwardly for each of the upper and lower plates and a central part generally perpendicular to the upper and lower plates. The central part of each side member may extend over more than half the height of the boom section and the inclined sections may be of differing lengths and thus inclined at different angles to the respective upper and lower plates. Preferably, the lower inclined sections are shorter than the upper inclined sections. The boom section may be reinforced by external belts, or by internal support plates.

9 Claims, 8 Drawing Figures

FIG. 6
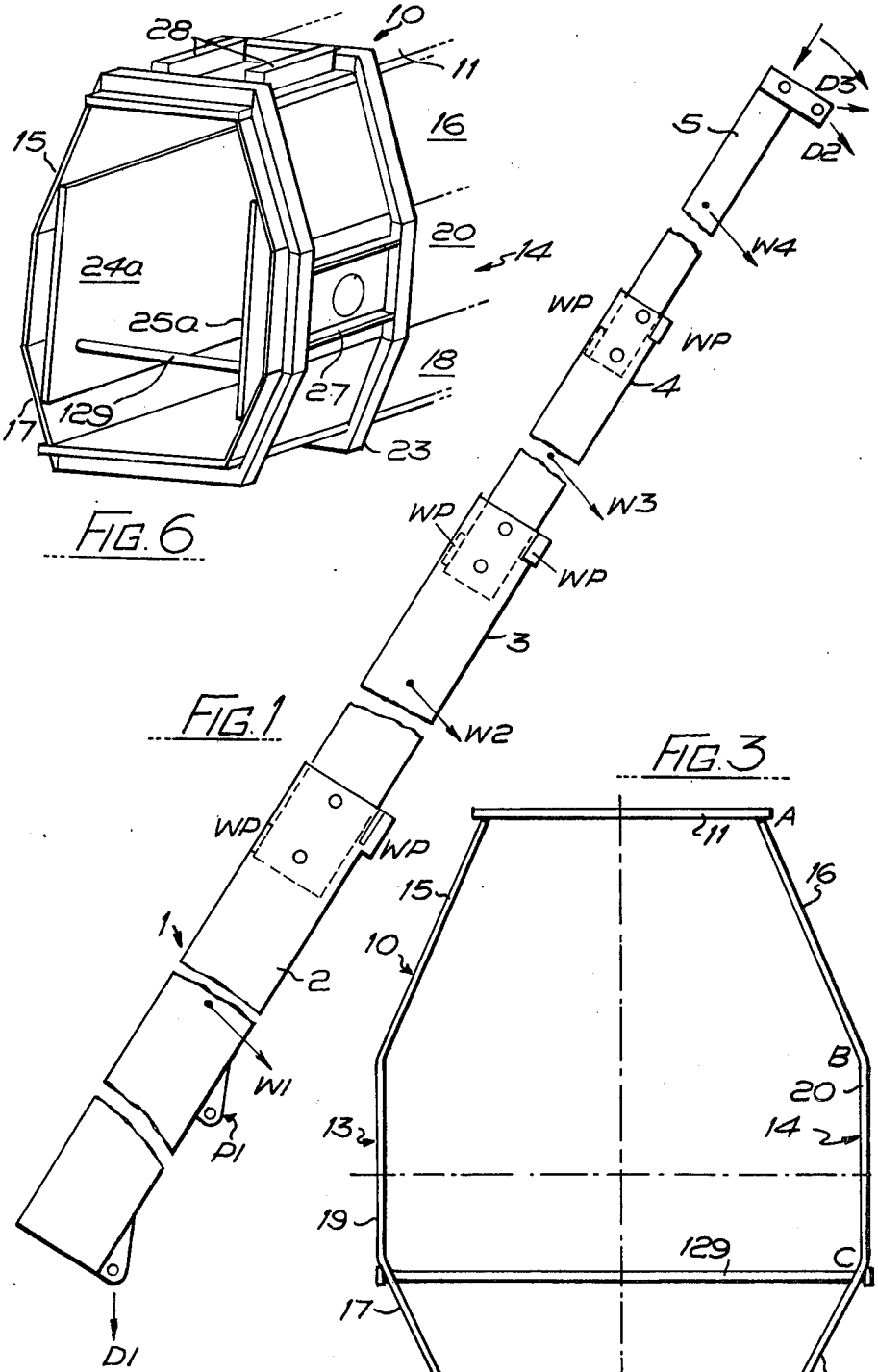
FIG. 1
FIG. 3
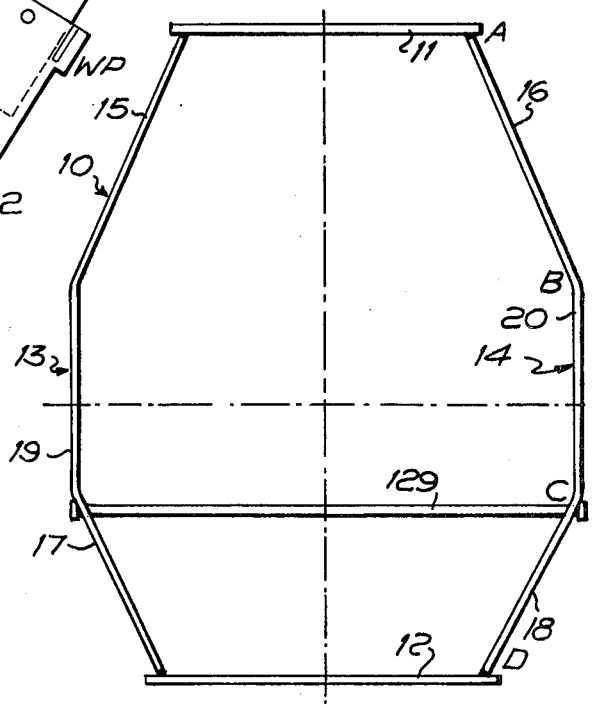

CRANE BOOM AND TELESCOPIC SECTION FOR IT

This application is a continuation-in-part application of application Ser. No. 761,036 filed Jan. 21, 1977, now abandoned.

Priority is claimed from Jan. 29, 1976, filing date in Great Britain of application No. 3444/76.

This invention relates to telescopic booms and boom sections. Such telescopic booms are composed of two or more "box" shaped sections, which are slidable one in another, and are constructed to be extended and retracted by hydraulic rams or chains so as to obtain a required boom length, the box shaped sections usually being slidable one in another for extending or retracting the boom for example of a crane mounted for instance on a transportable carrier.

Heretofore, in the art of telescopic boom design, the boom sections have generally been of a rectangular shape. For a given cross-sectional area (or weight per unit length) both the strength and overall bending stiffness can be improved by increasing the overall sizes of the boom sections while simultaneously decreasing the thickness of the constituent plates. From a strength viewpoint, this optimization reaches a limit due to the following main criteria. Firstly, owing to the action of the wear pads on the top flange of a boom section, any increase in the width of the flange produces higher local deformations of this flange resulting in higher stresses around the corner joints. Secondly, as the depth/thickness ratio of the constituent plates of a rectangular box-section increases, then the constituent plates become increasingly susceptible to local plate buckling. Whilst the onset of local plate buckling does not necessarily imply failure, it does reduce the ultimate bonding strength of the section and a stress, or combination of stresses, somewhat lower than yield (or proof) stress becomes the critical parameter. Thirdly, algebraic addition of the bending and direct compress on stresses results in the maximum stresses, both tension and compression, occurring at the corners of a rectangular boom cross-section. The yield point of the material is therefore reached at these corners of the cross-section, while the remainder of the cross-section is still within the elastic range. An object of the invention is to provide telescopic booms of box section in which corners of this type and spatial position are not featured for enabling a much more efficient use of the whole of the material of the cross-sectional area in contributing to the strength of the boom. A considerable increase in the payload carrying capacity of the boom is thus capable of being achieved without necessarily increasing the boom self-weight.

The immediately foregoing considerations are especially but not exclusively, important, having regard to lateral bending moments with respect to slewing motions underload as well as with consideration for material stiffness, for avoiding whip deflection in use.

It has been proposed to apply a series of spaced stiffeners to counteract shear stresses and offset the effects of local buckling in reducing the ultimate bending strength of a boom section and in combination with this expedient it has also been proposed to modify the traditional rectangular cross-sectional boom shape to one which is trapezoidal in the form of a truncated triangle.

The strength to weight ratio realizable increases progressively from a boom of square cross-section fabricated from two channel section members, a rectangular section made up of four plates to a larger four plate section with web stiffeners and an object of the present invention is to provide a telescopic boom having a strength to weight ratio which compares favorably with the best of those without the necessity of securing the additional material involved in a series of web stiffeners and more fully to utilize the properties of the material, usually steel, of the plates.

This invention provides a section for a telescopic crane boom, such section having an octogonal transverse cross-section. The invention also provides a crane boom having two or more such sections.

A preferred embodiment of boom section comprises a top plate and a bottom plate and a pair of side webs, the side webs each being formed with a central part perpendicular to the top and bottom plates, and upper and lower inclined portions connecting the central part to the top and bottom plates.

Upper and lower portions of the side webs preferably subtend an angle in the range of from 148° to 164° with the central side web portion, this permitting cooperative positioning for affording clearance between the telescopic sections and the provision therein of services, for example chains and/or hydraulic rams, in two to six mutually adjacent boom sections. The box sections should surround the cross-sectional areas of the booms and are usually closed.

The upper and lower flanges are separate plates secured for example by welding to their respective upper and lower web portions; the central portions of the side webs are in the range of from 20% to 50% of the height of the boom, and preferably in the range of from 30% to 47% e.g. 34–45%.

The side webs may be of somewhat thinner plate than the flanges; they could be formed from single plates e.g. by rolling or pressing. The angle subtended by the upper web portion is preferably somewhat larger than that subtended by the lower web portion with the central portion.

The ratio of the flange with respect to the overall width is usually in the range of from 45% to 60%.

A preferred embodiment of the invention will now be described and compared with the prior art, with reference to the accompanying drawings.

BRIEF DESCRIPTION OF THE DRAWINGS

FIG. 1 is a diagrammatic side view of an extended telescopic crane boom showing the loading on the sections of the boom.

FIG. 3 is a cross-sectional view of a crane boom section in accordance with the present invention.

FIG. 6 is an end perspective view of another boom section according to the invention showing internal and external reinforcement.

DESCRIPTION OF THE PREFERRED EMBODIMENT

Referring first of all to FIG. 1, there is shown an extended crane boom 1 made up of sections 2, 3, 4 and 5 which are telescopically received one inside the other, and provided with wear pads WP between each pair of sections, one wear pad being provided on the underside of the outer end of each sections 2, 3 and 4, and on the upper side of the inner end of each section 3, 4 and 5.

Upon utilizing the telescopic boom to move the payload from one position to another, a number of forces are exerted upon the boom as a result and upon the boom sections contained within. FIG. 1 illustrates the typical forces acting on the boom and the internal forces acting between adjacent sections. The forces result in bending stresses in the boom sections, in both the horizontal and vertical planes, along with a uniform compressive stress in each section owing to the component of the payload acting directly down the boom. Shear stresses result in the boom sections owing to the forces transmitted via the wear pads or rollers, upon which adjacent telescopic sections are supported, in both planes of bending, within each other and upon which one section slides inside the other. Other miscellaneous forces act upon the boom, such as caused by wind pressure and selfweight of the boom, and can be resolved into essentially similar forces to those previously described. Efficient boom design is achieved by minimization of the boom selfweight for a given boom strength and boom stiffness, this is especially important for high payload capacity booms of long boom length.

Stressing of the boom is effected by the payload exerting a moment along its length about the point of ground contact of the carrier and also by the weight of the material of the boom. Minimizing the latter maximizes the possible payload and accordingly the strength to weight ratio of the boom section is of primary importance especially in high capacity cranes with long booms; together with the requirement of strength there is a related stiffness criterion.

The forces and directions of these forces acting on each section are shown by arrows. Arrows W1–W4 show the direction of forces caused by selfweight and load on each individual boom section. P1 shows the pushing force of a raising ram, D1 shows the drag exerted by an end pivot of the boom to a chassis or support mounting, D2 the load exerted by payload, and D3 the load exerted in slewing when the payload is displaced by centrifugal force.

Figure 2:
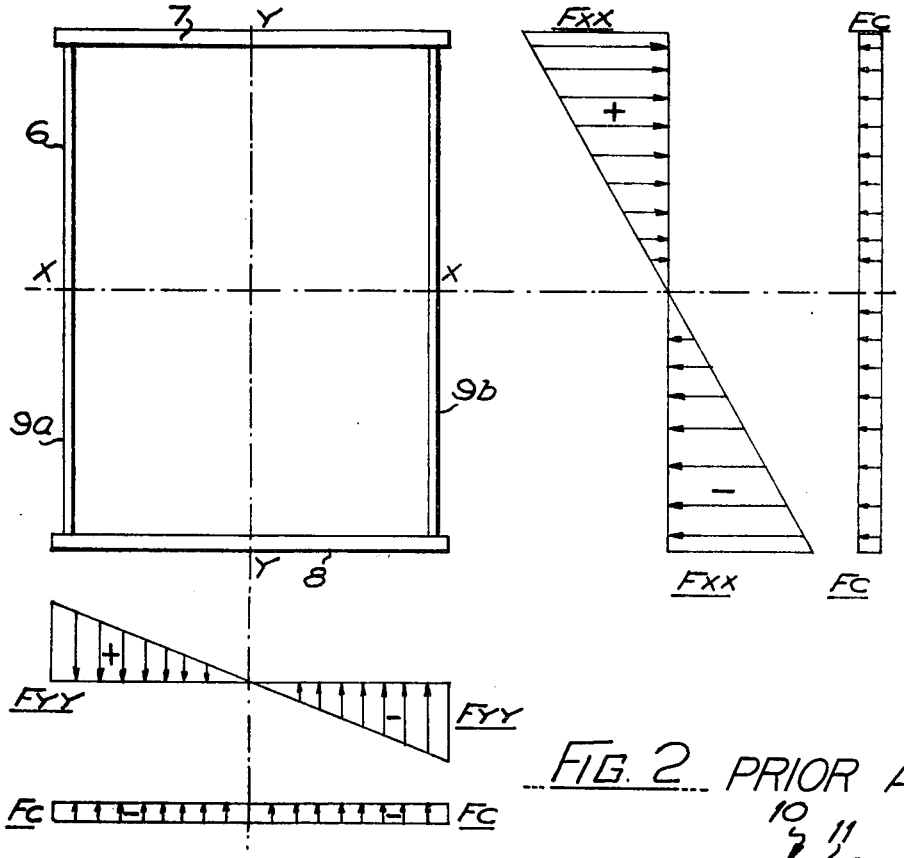
FIG. 2 PRIOR ART
FIG. 2 is a cross-sectional view of a crane boom section in accordance with the prior art and showing diagrammatically the stress distribution in such a boom caused; by direct compression, normal and lateral bending moments.

In order to meet the loading requirements of the boom sections, principally the forces W1–W4, it has in recent years become common place to build the sections of crane booms as shown in FIG. 2 which shows a boom section 6, comprising top and bottom plates 7 and 8 and side webs 9*a* and 9*b*. The wide webs are typically inset slightly from the edges of the plates 7, 8, leaving a flange at each corner of the boom sections.

The stress diagrams below and to the right of the cross-sections show the distribution of stress loading on the webs of the boom section, the symbol "+" indicating tension and "−" compression. It can be seen that the stress is applied more or less symmetrically, with the bottom plate 8 subject to maximum tension on the left hand side, and maximum compression on the right.

Similarly side web 9*b* is subject to maximum tension at the top and maximum compression at the bottom, zero stress being experienced near the center in both cases.

FIG. 3 shows a boom section in accordance with the present invention. The boom section 10 is octagonal in general shape, and comprises a top plate 11, and a bottom plate 12, and sides 13, 14 each comprised of three sections 15, 19, 17 and 16, 20, 18 respectively. The sections of each side 13, 14 are folded from a single sheet, and the sections 15, 16 are longer in the illustrated embodiment than the sections 17, 18. The central sections 19, 20 are in the range of from 20 to 50% of the height of the boom, and preferrably in the range of from 30 to 47%, e.g. 34–45%. In FIG. 3, they are about 30% of the boom height.

The side webs 13, 14 are shown as being of thinner plate than the flanges, and as being made from single plates by rolling or pressing. They could however be made by welding flat strips together. The top and bottom plates 11 and 12 are each from 35% to 65% preferably 45% to 60% of the total width of the boom. As particularly shown in FIG. 3, it is 57%. The upper inclined side sections 15, 16 and preferrably as shown longer than the lower side sections 17, 18.

Horizontally extending tie-bars 129 extend between and are connected to opposed side walls at their respective lower regions at the end region of the respective sections; this stabilizes cooperative sections and tie-bars 129 may be provided at spaced intervals along the innermost boom section.

A crane boom, unlike the rope supported derrick pole of U.S. Pat. No. 2,920,725 to Emmons, is subjected to higher bending moments in both the normal and lateral planes. The bending moment in the normal plane is unidirectional, that is, there is always compression on the lower faces, while the lateral bending moments can be in either direction. The resultant stresses in the sloping portions of the web are such that the lower portions 17, 18 are subjected to higher compressive stresses than the upper side web sections 15, 16. The present invention, therefore, in part advantageously employs a wider bottom plate 12 and reduced height inclined lower side plates to reduce the possibility of buckling of the bottom plate under compression, thus producing the irregular octagon vertical cross-section to the crane boom.

The angles between the side web sections and the adjacent plates 11, 12 are correspondingly different.

Figure 4:
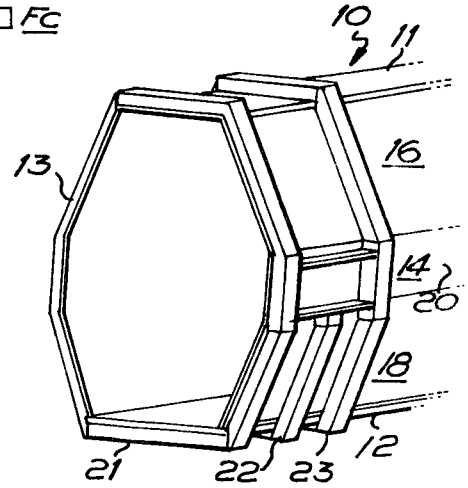
FIG. 4 is a fragmentary perspective view of the boom section of FIG. 3 showing how it is reinforced at its free end.

FIG. 4 shows an outer end of one boom section 10 wherein the end region is reinforced by peripheral straps 23, extending all the way around the section 10, and part straps 22 which only enclose the lower part of the boom, the straps being joined by horizontal tie-bars 27.

Figure 5:
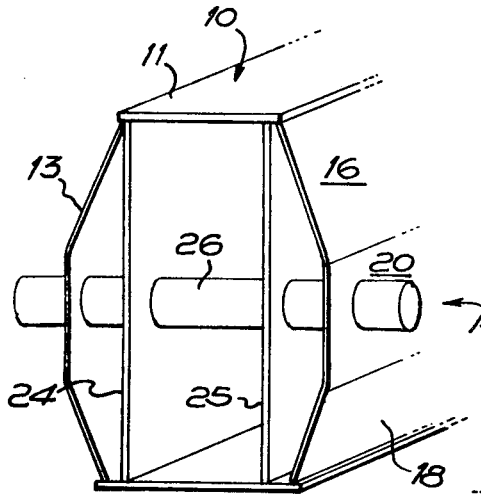
FIG. 5 shows an end perspective view of another boom section according to the invention showing a pivot tie, and internal reinforcement.

In FIG. 5, an alternative method of reinforcement is shown, with vertical reinforcement plates 24, 25 extending between the top and bottom plates 11, 12. 26 denotes a horizontal axle for carrying the pivot pin at the base of the boom.

In FIG. 6 is shown a further alternative, with vertical reinforcement plates 24*a*, 24*b*, seated on the inclined-side web parts 15, 17; 16, 18 respectively instead of the top and bottom plates. The end of the boom has two circumscribing straps 23, between which, on the top plate 11 are seated a pair of wear pads 28. Peripheral straps are joined by horizontal tie-bars 27.

The FIG. 4 embodiment may be used as part of a section of a boom such as section 2 in FIG. 1; and the FIG. 6 embodiment may be used as the lower end of intermediate boom section such as 3 and 4.

Figures 7A, 7B:
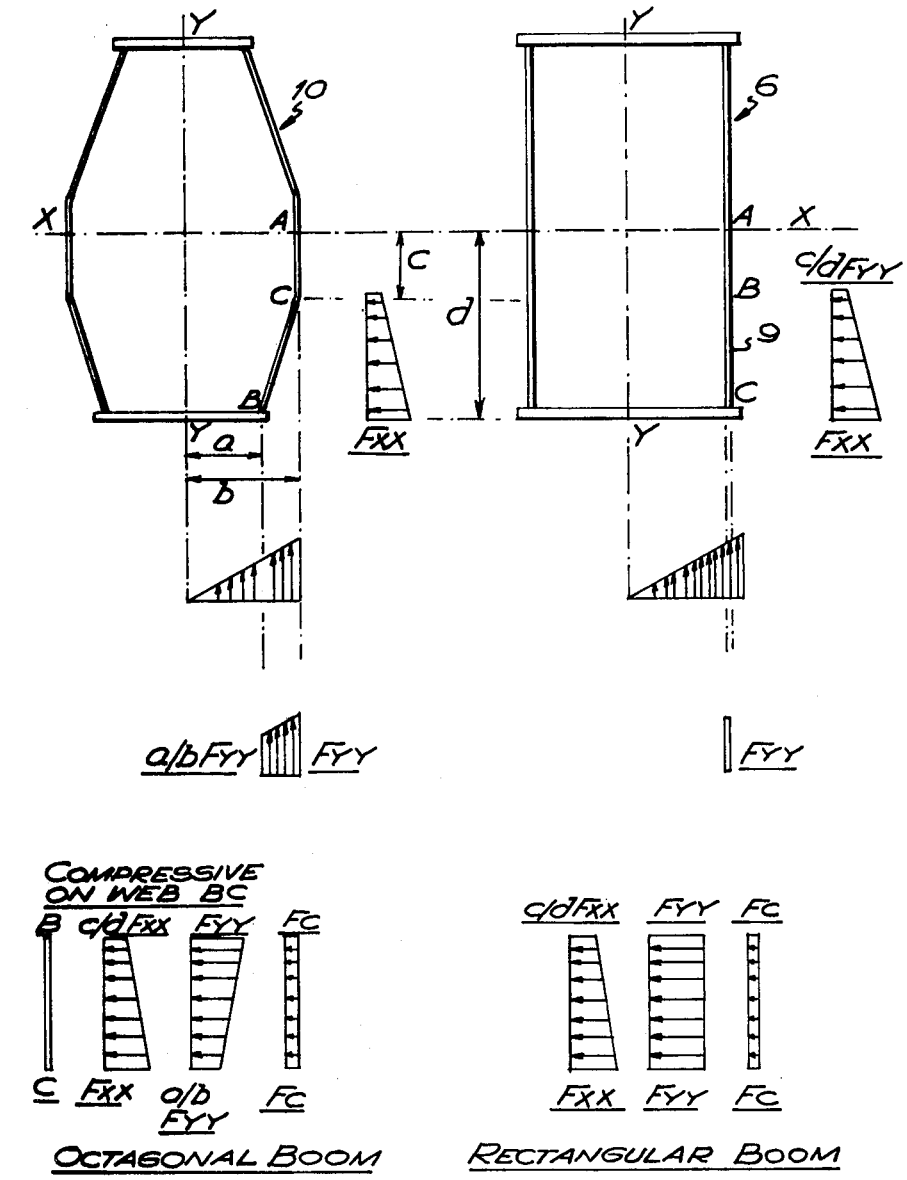
FIG. 7b PRIOR ART
FIGS. 7*a* and 7*b* are diagrams illustrating differences in compression stress distributions in a boom according to the invention, and a boom according to the prior art, respectively.

Finally, FIGS. 7*a* and 7*b* show comparative diagrams of the compressive stresses arising in a prior art boom section 6, and a section 10 in accordance with the invention.

This illustrates the change in distribution and generally lower stress levels arising in the boom of the invention.

In a specific boom section 23 inches wide and 34 inches high, having flanges 12.5 inches wide and central side web portions 11 inches high the strength to weight ratio was superior to that of a rectangular boom section, of comparable weight, length and height fabricated with spaces stiffeners along the side webs; in addition in the boom section according to the invention there was no risk of excessive rotation at the lateral edges of the flanges in reaction to the wear pads.

It is accordingly considered that an octagonal shaped boom has distinct advantages over a rectangular boom or any other type of stiffened web boom. The onset of local plate buckling in the lower flange is considerably delayed, by virtue of the fact that the widths of the flange plates are substantially smaller for a given plate thickness than on previous rectangular boom designs.

What is claimed is:

1. An extensible crane boom for subjection to extensive bending loads, said boom comprising:

a plurality of sections telescopically slidable with respect to each other, each section comprising a top plate, a bottom plate and a pair of convex single sheet side webs abutting said top and bottom plates within the side edges of said plates to provide a flange extending beyond the abutments of the side webs to said top and bottom plates, said top and bottom plates being thicker than said side webs, said webs each being formed with a central part extending substantially perpendicularly to said top and bottom plates and upper and lower integral, folded inclined parts connecting said central part to said top and bottom plates and being inclined inwardly from said central part to said top and bottom plates, respectively, and wherein said upper inclined parts for opposed side webs are of greater height than said lower inclined parts for the same side webs, to maximize resistance of the crane boom sections to buckling under applied load.

2. A boom according to claim 1, wherein said central part has a width in the range of from 20 to 50% of the height of the boom.

3. A boom according to claim 2, wherein said central part has a width in the range of from 30 to 45% of the height of the boom.

4. A boom according to claim 3, wherein said central part has a width of 34 to 45% of the height of the boom.

5. A boom according to claim 1, wherein said top and bottom plates have a width in the range of from 35% to 65% of the overall width of the boom.

6. A boom according to claim 5, wherein the width of said plates are in the range of 45% to 60% of the boom width.

7. A boom according to claim 1, wherein each boom section includes a free end, and said boom further including external reinforcement bands around the free end region of each section for terminating said boom.

8. A boom according to claim 1, further comprising reinforcing frames extending substantially perpendicularly between and contiguous with opposed side webs.

9. A boom according to claim 1, further comprising substantially horizontally extending tie-bars extending between and connected to respective lower regions of opposed side webs.

* * * * *